US007997427B2

(12) United States Patent
Lowenbraun et al.

(10) Patent No.: US 7,997,427 B2
(45) Date of Patent: Aug. 16, 2011

(54) MERCHANDISE DISPLAY SYSTEM

(75) Inventors: Howard Lowenbraun, Kenilworth, NJ (US); Dennis Polvere, Kenilworth, NJ (US); Jeff Leonard, Kenilworth, NJ (US)

(73) Assignee: Pepsico, Inc., Purchase, NY (US)

( * ) Notice: Subject to any disclaimer, the term of this patent is extended or adjusted under 35 U.S.C. 154(b) by 474 days.

(21) Appl. No.: 12/197,738

(22) Filed: Aug. 25, 2008

(65) Prior Publication Data

US 2010/0044325 A1 Feb. 25, 2010

(51) Int. Cl.
*A47F 1/04* (2006.01)
*A47F 7/00* (2006.01)

(52) U.S. Cl. ..... 211/59.2; 221/107; 221/108

(58) Field of Classification Search ..... 211/59.2, 211/85.5, 15, 59.3, 59.4, 74, 76, 133.6; 312/35, 312/42, 60, 45, 72, 73; 221/67, 104, 105, 221/107, 109, 110, 111, 114, 112, 175, 176, 221/177, 178, 180, 108
See application file for complete search history.

(56) References Cited

U.S. PATENT DOCUMENTS

| | | | | | |
|---|---|---|---|---|---|
| 1,841,926 | A | * | 1/1932 | Zuehl | 221/75 |
| 2,336,382 | A | * | 12/1943 | Albrecht | 221/107 |
| 2,376,561 | A | * | 5/1945 | Smith | 221/279 |
| 2,408,380 | A | * | 10/1946 | Dennis | 312/42 |
| 2,442,025 | A | * | 5/1948 | Smith | 193/17 |
| 2,453,280 | A | * | 11/1948 | Stewart | 221/107 |
| 2,562,015 | A | * | 7/1951 | Cattanach | 194/244 |
| 2,933,217 | A | * | 4/1960 | Salisbury et al. | 221/109 |
| 3,318,455 | A | * | 5/1967 | Takahashi | 211/59.2 |
| 3,368,714 | A | * | 2/1968 | Wingate et al. | 221/108 |
| 3,613,946 | A | * | 10/1971 | Klem | 221/109 |
| 3,733,007 | A | * | 5/1973 | Ungerman | 221/295 |
| 3,938,700 | A | | 2/1976 | Camp et al. | |
| 4,105,126 | A | * | 8/1978 | Deffner et al. | 211/59.2 |
| 4,228,903 | A | | 10/1980 | Eckert | |
| 4,232,800 | A | * | 11/1980 | Martin et al. | 221/109 |
| 4,303,179 | A | * | 12/1981 | Spring | 221/7 |
| 4,356,923 | A | | 11/1982 | Young et al. | |
| 4,744,489 | A | * | 5/1988 | Binder et al. | 221/6 |
| 5,080,256 | A | * | 1/1992 | Rockola | 221/109 |
| 6,149,031 | A | | 11/2000 | Baumann et al. | |
| 6,176,392 | B1 | * | 1/2001 | William et al. | 221/109 |
| 6,367,653 | B1 | * | 4/2002 | Ruskin et al. | 221/1 |
| 6,845,880 | B2 | * | 1/2005 | Charmasson et al. | 221/107 |
| 2006/0161293 | A1 | | 7/2006 | William et al. | |

* cited by examiner

FOREIGN PATENT DOCUMENTS

FR 2867369 9/2005

*Primary Examiner* — Darnell M Jayne
*Assistant Examiner* — Stanton L Krycinski
(74) *Attorney, Agent, or Firm* — Banner & Witcoff, Ltd.

(57) ABSTRACT

A display cradle for storing and dispensing containers such as beverage cans and bottles. Containers are loaded from the rear of the display cradle onto shelves sloping downward from the back of the display cradle to the front of the display cradle. The bottom shelf of the display cradle includes an exit port at the front of the assembly, allowing containers to be removed from the display cradle. The display cradle includes an exit channel between a front wall and the front end of the shelves where the containers from each shelf drop through towards the exit port. A gate at the front end of each shelf pivots under the weight of the containers, allowing the front-most container on each shelf to enter the exit channel while preventing subsequent containers from entering the exit channel. When the containers have exited the exit channel, the biased gate tilts back allowing the next container on each shelf to repeat the sequence. The biased gates on each shelf may operate in unison with each other.

18 Claims, 4 Drawing Sheets

MERCHANDISE DISPLAY SYSTEM

FIELD OF THE INVENTION

The present invention relates generally to the display and storage of consumer articles and more particularly for cylindrical containers, such as beverage cans and bottles.

BACKGROUND OF THE INVENTION

Beverage containers, such as soda cans and bottles are commonly displayed and sold individually at grocery stores, gas stations, drug stores and convenience stores. Typically, the beverage containers are manually loaded onto a display rack, shelving unit, or refrigeration display unit. Often, containers of the same type and same size are stored next to and behind each other in rows extending from the front of the shelf to the back of the shelf. The containers are usually arranged in an upright or vertical manner and are usually positioned in rows of like products on an inclined shelf such that the bottoms of the containers rest on the shelf. In these typical displays, the containers are loaded from the rear of the shelf and the containers slide forward on the shelf toward the front of the shelf.

Conventional displays for merchandising containers in an upright manner have certain drawbacks. For example, each display must have a considerable length in order to stock an adequate supply of containers. To stock an adequate supply of containers, the display must be as long as the cumulative diameters of the stocked containers. Additionally, typical displays include unused space above the containers to allow clearance between the containers and a shelf above the containers. Furthermore, vertically standing containers may topple when being loaded, when the container slides down the channel, or when the forward-most product is removed from the shelf. The toppling of one or more containers may block and prevent subsequent containers from being properly displayed and merchandised.

These and other known drawbacks and disadvantages with existing container display systems are overcome with the present invention.

SUMMARY OF THE INVENTION

The present invention is directed to a display cradle or system that may be used in many applications, including displaying and storing beverages containers at grocery and convenience type stores. The present invention is also directed toward a display and storage cradle or system that better utilizes space by increasing the quantity of containers that may be stored and displayed in a standard refrigeration unit or cooler, thereby reducing the frequency in which product needs to be restocked on the shelf, while increasing the amount of merchandise on the shelf.

According to one aspect of the present invention, the display cradle has a bottom shelf, sidewalls, and at least one intermediate shelf. The bottom shelf and at least one intermediate shelf slope downwards from the rear end of the display cradle to the front end of the display cradle. The rear end of the display cradle remains open to allow containers, such as bottles or cans to be loaded onto the at least one intermediate shelf. In another aspect of the present invention, the display cradle has a plurality of intermediate shelves. The bottom shelf extends forward to form an exit port at the front end of the display cradle. Consumers may remove a container or a plurality of containers from the exit port.

The display cradle further includes a partial front wall configured to allow the containers to pass under it while moving along the bottom shelf to the exit port. The display cradle also includes an exit channel at the front end of the display. An exit channel is formed between the partial front wall and the at least one intermediate shelf or plurality of intermediate shelves, allowing containers to drop from each of the one or more intermediate shelves toward the bottom shelf and exit the display cradle at the exit port.

Each of the one or more intermediate shelves includes a biased gate pivotally mounted to the front of each of the one or more intermediate shelves. The bottom shelf also includes a biased gate pivotally mounted to the top surface near the front of the display cradle, adjacent the exit port. The biased gates on the bottom shelf and the one or more intermediate shelves pivot under the weight of a container, such that a front-most container on the one or more intermediate shelves may enter the exit channel and a front-most container on the bottom shelf may enter the exit port. While containers are positioned within the exit channel, the biased gates remain tilted, acting as barriers preventing subsequent containers positioned on the one or more intermediate shelves and bottom shelf from entering the exit channel or the exit port. When all of the containers have exited the exit channel, each gate pivots back allowing the subsequent container on the one or more intermediate shelves and the bottom shelf to enter the exit channel and the exit port, thereby repeating the dispensing sequence. The biased gates on the one or more intermediate shelves and the bottom shelf may be connected to each other to operate in unison, allowing a front-most container to roll off of each of the one or more intermediate shelves into the exit channel and a container to roll off the bottom shelf into the exit port at the same time.

According to another aspect of the invention, each of the one or more intermediate shelves and the bottom shelf may include at least one biased ramp configured to slow down the momentum of a container rolling from the rear of the at least one intermediate shelf or bottom shelf to the front of the at least one intermediate shelf or bottom shelf. The at least one biased ramp may also be configured to prevent subsequent containers from putting weight on the front-most container on the at least one intermediate shelf. In another aspect of the invention, each of the one or more intermediate shelves and bottom shelf may include a plurality of biased ramps positioned at increments or various locations along the shelves or surface. In a further aspect of the invention, each of the one or more intermediate shelves and bottom shelf may include a biased ramp at the rear of the one or more shelf or bottom shelf, which serves as a barrier, preventing containers from falling off the rear end of the shelves or bottom shelf.

Other features and advantages of the invention will become apparent to those skilled in the art upon review of the following detailed description, claims and drawings in which like numerals are used to designate like features.

Figure 1:
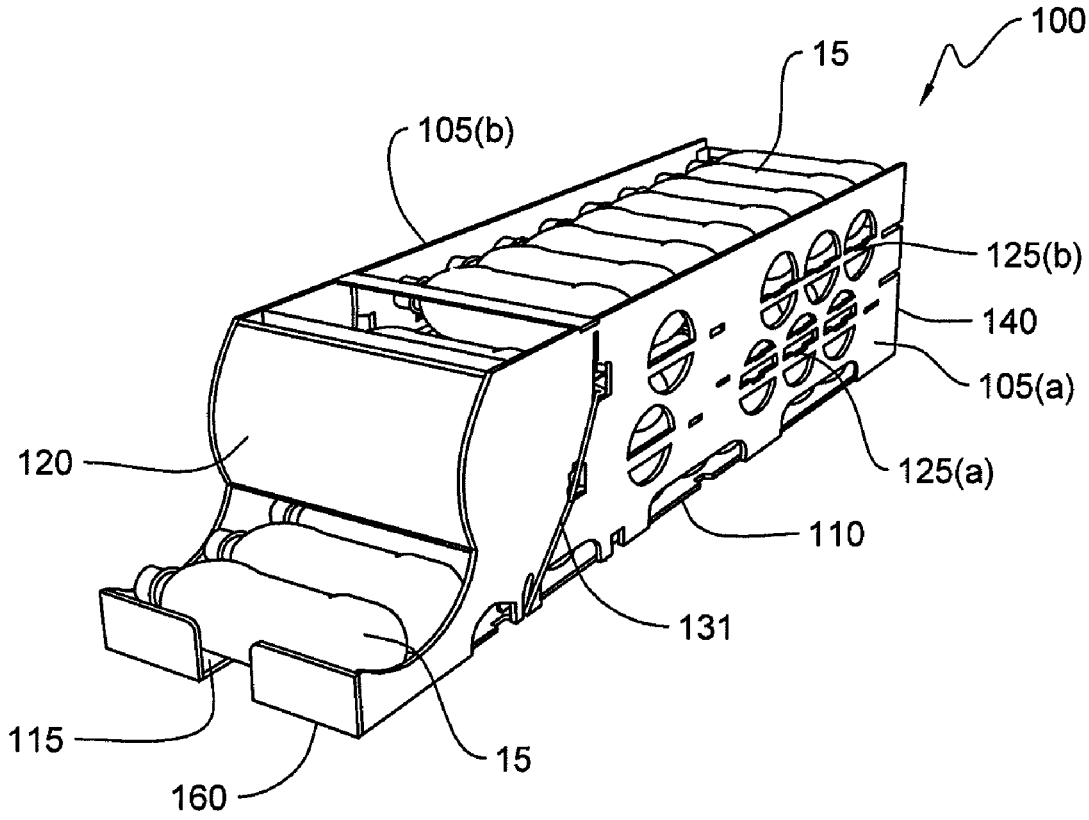
FIG. 1 is an isometric view of an assembled embodiment of the display cradle illustrating beverage containers within the cradle.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE EMBODIMENTS

The present invention, a display cradle 100 for displaying and storing articles such as beverage containers in a horizontal configuration, is illustrated in FIG. 1. The display cradle may be used to display and dispense various sized containers, such as 12-ounce, 16-ounce, 20-ounce, one liter or two liter cans or bottles. The display cradle 100 may include a bottom shelf 110, side walls 105*a*, 105*b*, a partial front wall 120, and at least one intermediate shelf 125 positioned above the bottom shelf 100 between the two side walls 105*a*, 105*b*. The rear end 140 of the display cradle 100 may remain open to allow containers 15 such as beverage containers to be loaded into the display cradle 100. The top of the display cradle 100 may remain open or may include a cover. The bottom shelf 110 may form an exit port 115 at the front end of the display cradle 100. The exit port 115 allows consumers to remove beverage containers for purchase.

Figure 2:
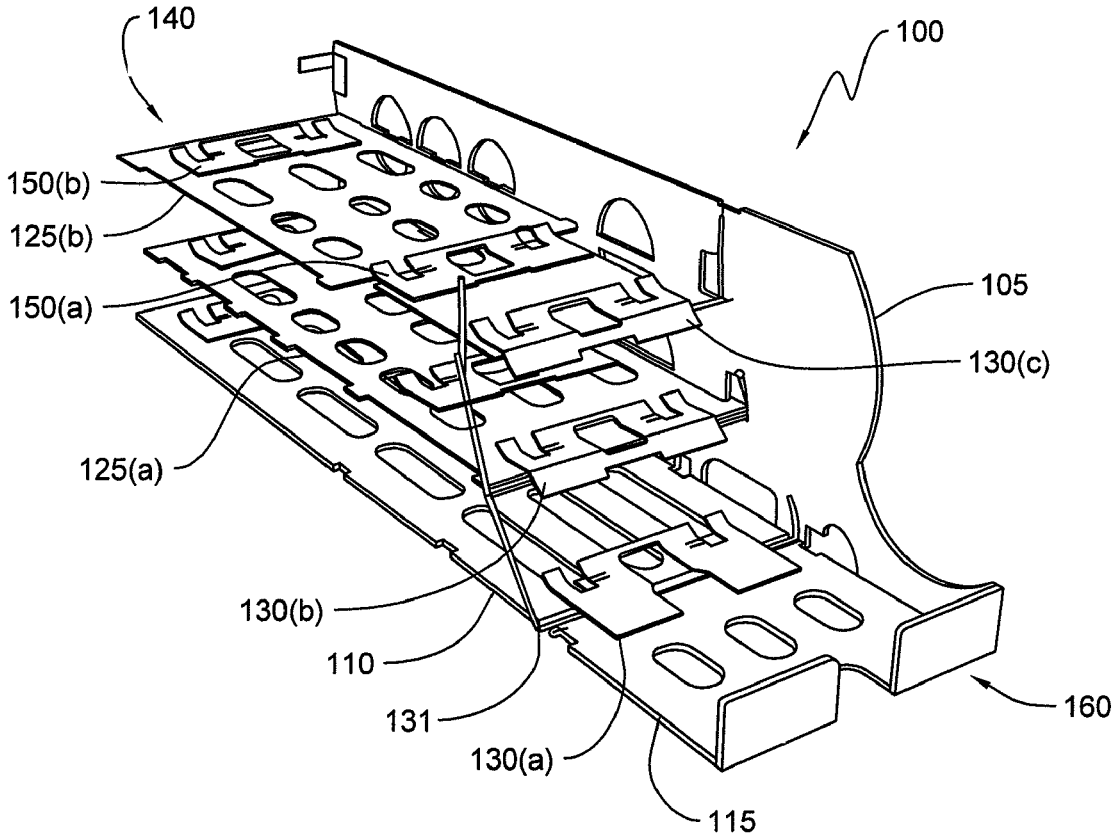
FIG. 2 is a cross-sectional isometric view of the assembled display cradle.

In at least one embodiment, the display cradle 100 may include a plurality of intermediate shelves 125*a*, 125*b*, as illustrated in FIG. 2. The display cradle 100 may include one shelf 125, two shelves 125*a*, 125*b*, or more, depending on the available space on the shelf in the retail store. In an exemplary embodiment, the display cradle 100 may include a bottom shelf 110, an intermediate shelf 125*a*, and a top shelf 125*b*. Each of the at least one intermediate shelf 125 and the bottom shelf 110 may decline or slope from the rear end 140 of the display cradle 100 to the front end 160 of the display cradle 100.

The partial front wall 120 may be positioned to form a gap to define the exit port 115 such that containers may roll down the bottom shelf 110 and pass through the gap under the partial front wall 120 and then through the exit port 115. The partial front wall 120 may be configured to include a graphic panel for advertisement purposes. For example, the partial front wall 120 may include a panel advertising the type of beverage and size of container it is dispensing. In one embodiment, the partial front wall 120 may be planar. In an alternative embodiment, the partial front wall 120 may be curved or define a contoured surface.

The display cradle 100 is configured to fit within existing coolers or shelves at grocery stores, convenience stores, gas stations, and drug stores or any type of store that displays and dispenses individual beverage containers. As stated above, the display cradle 100 may be configured to display and store various sizes of bottles or cans. In an exemplary embodiment, the display cradle 100 may display and store 20-ounce bottles. In one embodiment of the invention, the display cradle 100 may be the approximate width of the cumulative diameters of three 20-ounce bottles and may be of a height equivalent to one 20-ounce bottle. In other embodiments of the invention, the height and width of the display cradle 100 may vary depending on the container being displayed or the available space.

The display cradle 100 may be configured to fit within the depth of existing shelving units or coolers. For example, typical display coolers in convenience stores have shelves that can contain nine 20-ounce bottles in a single row of products. So, for three rows of product, the typical display cooler may hold twenty-seven bottles. In at least one embodiment of the invention, the display cradle 100 may be configured with a depth equivalent to the standard cooler shelf and a width equivalent to three rows of 20-ounce bottles. With the present invention, however, and as explained below, the display cradle may hold thirty 20-ounce bottles, thus permitting the merchandising of more products in the same amount of shelf space.

In an alternative embodiment, the display cradle 100 may be configured with a depth greater than the length of a store shelf 200, such that the display cradle 100 extends beyond the store shelf 200 into the back of a refrigeration unit or cooler to increase storage capacity. It should be understood that various heights, widths, and depths are possible with the display cradle 100 and are within the scope of the invention. The height, width, and depth may be determined by the size of container being dispensed or the available merchandise space. In existing coolers, the display cradle 100 may be configured to rest on a front wire or bar of the shelf to ensure the display cradle 100 remains fixed in place. In one embodiment, the display cradle 100 may be fixed and secured to the store shelf 200. In another embodiment, the display cradle 100 may be removable. In at least one embodiment, the display cradle 100 may be configured to be stackable on top of other display cradles 100.

Existing coolers displaying beverage containers include a clearance space between the beverage containers and an upper shelf. To better utilize the existing space, the display cradle 100 displays the beverage containers in a horizontal configuration. This configuration increases the amount of bottles that may be dispensed in a given space. For example, in the existing configurations displaying nine bottles deep by three bottles wide, the display cradle 100 can store thirty bottles. This configuration therefore allows for less frequent stocking of the display cradle 100 and for more product to be displayed and ultimately sold.

Containers or bottles may be loaded onto the display cradle 100 such that the top of the bottle may be positioned either to the left or to the right. A tight clearance between the display cradle 100 and the side walls 105*a*, 105*b*, ensures that bottles do not skew or hang up in the display cradle 100. Containers or bottles may be reloaded onto the display cradle 100 by setting them on top of the bottles in the exit port 115.

The display cradle 100 may be configured to allow air to flow over the containers for maximum cooling. For example, portions of the side walls 105*a*, 105*b*, may be cut out to allow air flow through each of the intermediate shelves 125 and the bottom shelf 110. The rear of the display cradle 100 may remain open to allow air flow through the back of the display cradle 100. Additionally, the top of the display cradle 100 may remain open or may have portions cut out of it to facilitate air flow over the beverage containers on the uppermost shelf. In one embodiment, the bottom shelf 110 and the at least one intermediate shelf 125 may include cut out portions to facilitate air flow through the bottom shelf 110 and the at least one intermediate shelf 125.

As illustrated in FIG. 1, the exit port 115 is formed by a portion of the bottom shelf 110 that extends forward past the front wall 120. The exit port 115 may include a barrier at the front end to prevent beverage containers from rolling off of the display cradle 100. The exit port 115 may further include partial sidewalls extending from the sidewalls 105*a*, 105*b*, of the display cradle 100. The partial sidewalls may help direct the bottles rolling into the exit port 115 and further contain the bottles within the exit port 115. The exit port 115 may hold one container or a plurality of containers.

As shown in FIGS. 3*a*-3*c* and 4*a*-4*c* each of the one or more intermediate shelves 125 extend from the rear end 140 of the display cradle 100 toward the front wall 120, but leave a gap between the front end of each of the one or more intermediate shelves 125 and the front wall 120. This gap forms an exit channel 122 or a pathway for containers to travel from the one or more intermediate shelves 125 to the bottom shelf 110 to the exit port 115. In an embodiment with a plurality of intermediate shelves 125, each of the plurality of shelves 125*a*, 125*b*, may be staggered to form an angled exit channel 122. In this embodiment, the display cradle 100 may include a front panel to help direct articles through the angled exit channel 122.

Each of the one or more intermediate shelves 125 may include a biased gate 130*b*, 130*c* pivotally mounted to the front end of the one or more intermediate shelves 125. The bottom shelf 110 may also include a biased gate 130*a* pivotally mounted to the bottom shelf 110, adjacent to and leading into the exit port 115. The biased gates 130*a*, 130*b*, 130*c*, pivot under the weight of a container 15. When a front most container on the one or more intermediate shelves 135 rolls onto the biased gate 130, the biased gate 130 pivots such that a container is allowed to roll off the one or more intermediate shelves 125*a*, 125*b* into the exit channel 122. Additionally, the biased gate 130*a* on the bottom shelf 110 pivots under the weight of a container such that a container is allowed to roll off the bottom shelf 100 into the exit port 115. When pivoting under the weight of a container, the biased gates 130*a*, 130*b*, 130*c*, simultaneously act as a barrier so that subsequent containers may not enter the exit channel 122 or the exit port 115.

Figure 3A:
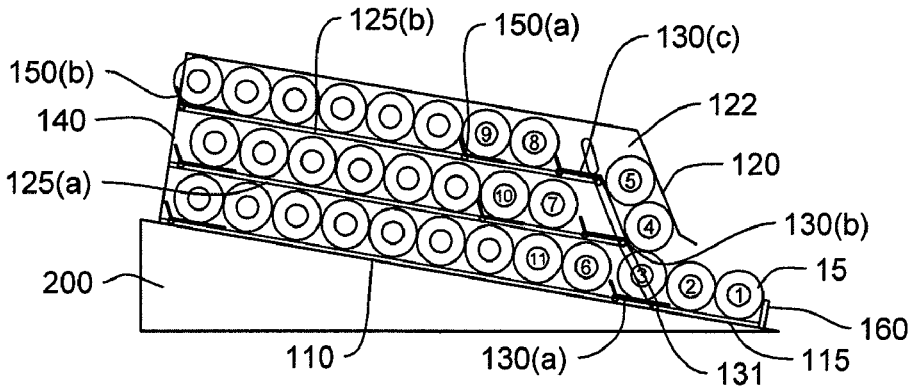
FIGS. 3*a*, 3*b* and 3*c* are side views of the display cradle in operation.
Figure 3B:
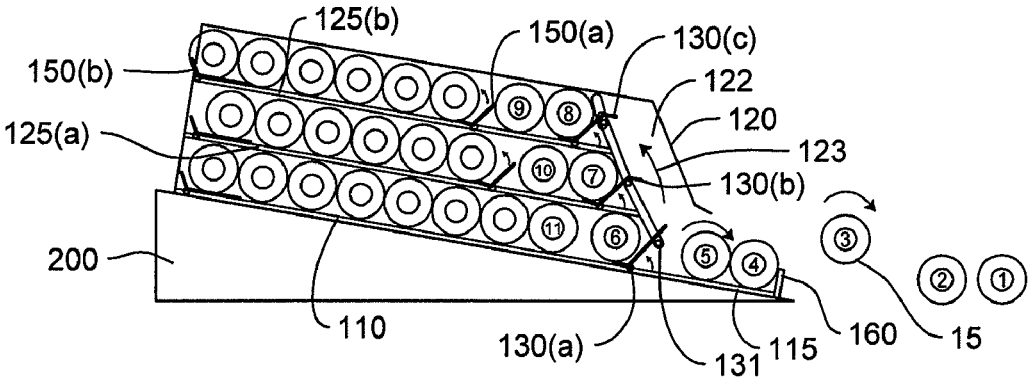
Figure 3C:
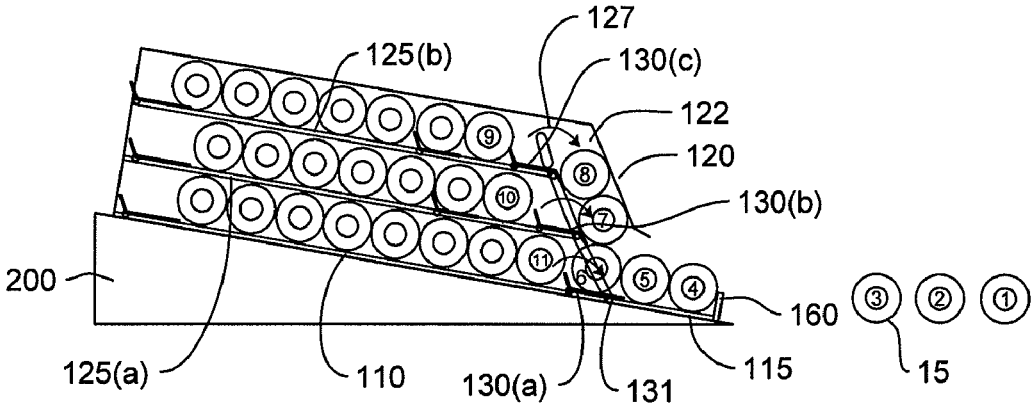
Figure 4A:
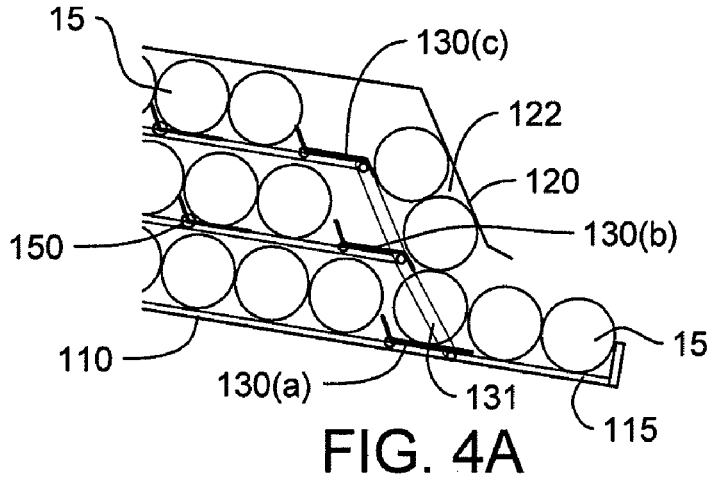
FIGS. 4*a*, 4*b* and 4*c* are partial side views of the display cradle in operation.
Figure 4B:
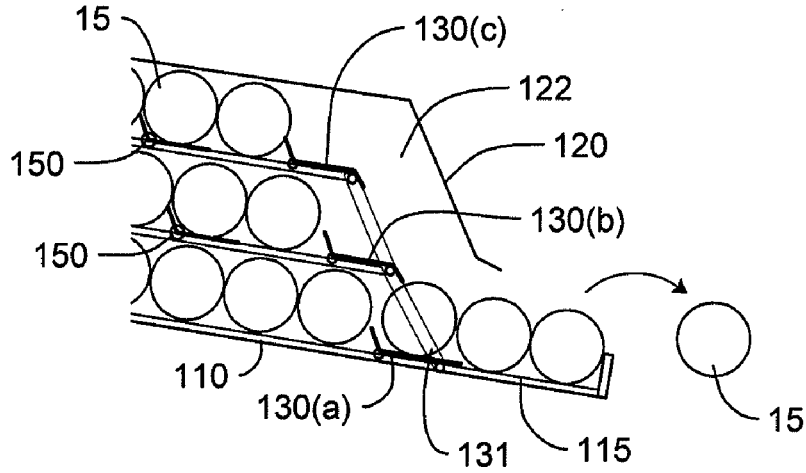
Figure 4C:
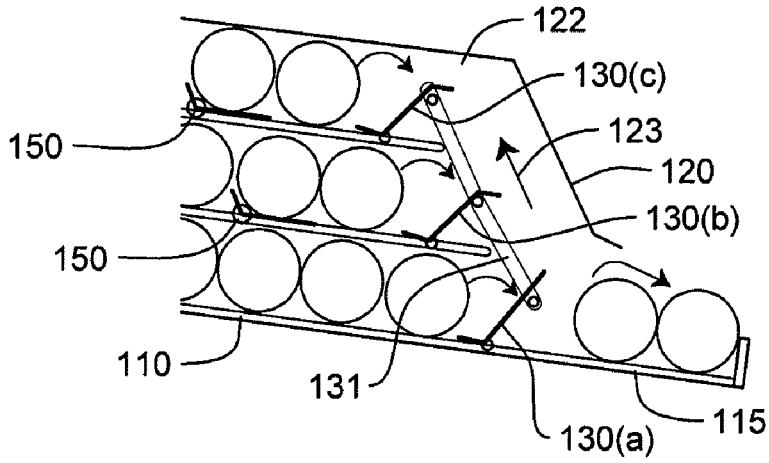

The biased gates 130 on each of the one or more intermediate shelves 125 and the bottom shelf 110 may operate independent of each other. In at least one embodiment, the biased gate 130 on each of the one or more intermediate shelves 125 and the biased gate 130 on the bottom shelf 110 may operate in unison with each other. In at least one embodiment, the biased gates 130*a*, 130*b*, 130*c*, on the one or more intermediate shelves 125 and the bottom shelf 110 are connected to each other by a spring-loaded connector 131. The spring-loaded connector 131 may be a bar or rod connecting the biased gates and may be positioned on the outside or inside surface of the side walls 105*a*, 105*b*. If a spring-loaded connector 131 is used to allow the biased gates to operate in unison, as shown in FIGS. 3*a*-3*c*, the containers 15 (some of which are numbered 1 through 11) will be dispensed in the sequence illustrated. That is, container number 1 will dispense first followed by container number 2, and so forth. More specifically, as shown in FIG. 3*a*, the connector 131 is in the downward position because of the weight of the container number 3 on the biased gate 130*a*. In this position, the biased gates 130*a*, 130*b* and 130*c* will permit containers on the gates to move to the exit channel 122 while simultaneously blocking additional containers on the respective shelves. Referring to FIG. 3*b*, as containers numbered 1 through 5 exit out of the channel 122 and exit port 115, there no longer remains any weight on the biased gate 130*a* and the spring biased connector 131 is allowed to move upward (as indicated by direction arrow 123) which in turn causes the gates 130*a*, 130*b* and 130*c* to bias and receive more containers (that were previously blocked by the gates on the shelves). And, as shown in FIG. 3*c*, the weight of these containers will then cause the gates 130*a*, 130*b* and 130*c* to bias again in unison (as indicated by direction arrow 127) thereby permitting the containers to move into the exit channel 122 for subsequent dispensing. This sequence may be repeated as containers are removed from the exit port. It should be understood that the operation illustrated and described is merely exemplary of an embodiment of the invention. Indeed, the biased gates 130 may be of any suitable configuration that allows containers to roll onto the biased gates 130, pivot under the weight of a container, roll off of the biased gate 130, and act as a barrier to block subsequent containers.

As illustrated in FIGS. 3*a*-3*c* and 4*a*-4*c*, in one embodiment, the biased gates 130*a*, 130*b*, 130*c*, prevent subsequent containers from entering the exit channel 122 until all of the containers have exited the exit channel 122 and are in the exit port 115. In an alternative embodiment, the biased gates 130*b*, 130*c* on the one or more intermediate shelf 125*a*, 125*b*, allow subsequent containers to enter the exit channel 122 when the containers are not exerting weight on the biased gates 130*b*, 130*c* of the one or more intermediate shelf 125*a*, 125*b*.

In another embodiment, each of the one or more intermediate shelves 125 and the bottom shelf 110 may include a biased ramp 150 pivotally mounted to a top surface of each of the one or more intermediate shelves 125 and the bottom shelf 110. The biased ramp 150 pivots under the weight of the containers 15 to slow the momentum of containers rolling down the one or more intermediate shelves 125 and bottom shelf 110. When the weight of a container rests on the biased ramp 150, the biased ramp 150 also acts as a barrier preventing subsequent containers from exerting too much weight on the front-most container. In an alternative embodiment, the one or more intermediate shelves 125 and bottom shelf 110 may include a plurality of biased ramps 150*a*, 150*b* (FIG. 3*a*), located at various positions on each of the one or more intermediate shelves 125 and bottom shelf 110. In at least one embodiment, a biased ramp 150 may be positioned at the rear end of each of the one or more intermediate shelves 125 and the bottom shelf 110 to ensure the containers do not roll backwards off the one or more intermediate shelves 125 and bottom shelf 110. The biased ramps 150 may be of any suitable configuration to allow containers to roll onto the biased ramp 150, roll off of the biased ramp 150, and block subsequent containers when the biased ramp 150 has the weight of a container on top of the biased ramp 150.

Any suitable materials may be used in constructing the display cradle 100. For example, the display cradle 100 may be made entirely of plastic or metal. Alternatively, different parts of the display cradle 100 may be made of different materials. For example, the shelves 125 may be made of the same material as the side walls 105*a*, 105*b*, and the bottom shelf 110, or they may all be made of different materials. The biased gates 130 and the biased ramps 150 may be made of any suitable material such as plastic or metal.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A display for storing and dispensing containers, comprising:

a front end and a rear end;

a bottom shelf sloping downward from the rear end to the front end, the bottom shelf having a top surface;

a pair of side walls extending upward from the bottom shelf;

at least one intermediate shelf operatively attached to and positioned between the side walls, the at least one intermediate shelf sloping downwards towards the front end, the at least one intermediate shelf having a top surface;

the rear end being open to allow loading of containers onto the at least one intermediate shelf;

a partial front wall positioned near the front end and between the pair of sidewalls, the partial front wall positioned such that a gap is formed between the partial front wall and the bottom shelf, wherein the gap is configured to allow containers to roll along the bottom shelf and pass under the partial front wall;

wherein the bottom shelf forms an exit port for dispensing containers, the exit port extending forward from the partial front wall;

the at least one intermediate shelf extending from the rear end toward the front end forming an exit channel between the partial front wall and the at least one intermediate shelf;

a biased gate pivotally mounted on the at least one intermediate shelf near the front end of the at least one intermediate shelf and a biased gate pivotally mounted on the bottom shelf adjacent the exit port;

wherein the biased gate on the at least one intermediate shelf pivots under the weight of a front-most container, allowing the front-most container on the at least one intermediate shelf to enter the exit channel, wherein the biased gate on the bottom shelf pivots under the weight of a front-most container, allowing the front-most container on the bottom shelf to enter the exit port, wherein the biased gate on the at least one intermediate shelf and the biased gate on the bottom shelf act as barriers preventing subsequent containers from entering the exit channel when the weight of a container is on the biased gate of the at least one intermediate shelf, and wherein the biased gate on the at least one intermediate shelf is connected to and operates in unison with the biased gate on the bottom shelf, allowing a front-most container from each of the plurality of intermediate shelves to enter the exit channel and at the same time into the exit port.

2. The display of claim 1, wherein the biased gate on the at least one intermediate shelf and the biased gate on the bottom shelf act as barriers preventing subsequent containers from entering the exit channel until all of the containers have exited the exit channel and entered the exit port.

3. The display of claim 1, wherein the at least one intermediate shelf is a plurality of intermediate shelves, each of the plurality of intermediate shelves including a biased gate pivotally mounted to the front end of each of the plurality of intermediate shelves.

4. The display of claim 1, wherein a biased ramp is pivotally mounted on the top surface of the at least one intermediate shelf and the top surface of the bottom shelf, the biased ramps configured to decrease momentum of containers rolling down the at least one intermediate shelf and the bottom shelf and configured to bias under the weight of a container to act as a barrier such that subsequent containers do not exert weight on a forward container on the at least one intermediate shelf and the bottom shelf.

5. The display of claim 4, wherein the biased ramp on the at least one intermediate shelf and the bottom shelf are a plurality of biased ramps pivotally mounted on the top surface of the at least one intermediate shelf and the top surface of the bottom shelf.

6. The display of claim 3, wherein a biased ramp is pivotally mounted on a top surface of at least one of the plurality of intermediate shelves and on a top surface of the bottom shelf, wherein the biased ramps reduce momentum of containers rolling down the at least one intermediate shelf and the bottom shelf and bias under the weight of a container to act as a barrier such that subsequent containers do not exert weight on the forward container.

7. The display of claim 6, wherein the biased ramp on the at least one of the plurality of intermediate shelves and bottom shelf are a plurality of biased ramps pivotally mounted on the top surface of the plurality of intermediate shelves and the top surface of the bottom shelf.

8. The display of claim 1, wherein the at least one intermediate shelf includes a biased ramp at the rear end of the at least one intermediate shelf and a biased ramp on the rear end of the bottom shelf to prevent containers from falling off the rear end of the at least one intermediate shelf and the rear end of the bottom shelf.

9. The display of claim 3, wherein each of the plurality of intermediate shelves includes a biased ramp at the rear end of each of the intermediate shelves and the rear end of the bottom shelf to prevent containers from falling off the rear end of the intermediate shelves and the rear end of the bottom shelf.

10. The display of claim 3, wherein each of the plurality of intermediate shelves are staggered such that they form an angled exit channel.

11. A display for storing and dispensing containers, comprising:

a front end and a rear end;

a bottom shelf sloping downward from the rear end toward the front end, the bottom shelf having a top surface;

a plurality of intermediate shelves positioned above the bottom shelf, each of the plurality of intermediate shelves sloping downwards towards the front end;

an open rear end allowing containers to be loaded onto the at least one intermediate shelf;

a front wall positioned forward of the intermediate shelves, the front wall positioned so that a gap remains between the front wall and the bottom shelf, allowing a container to roll down the bottom shelf under the front wall;

wherein the bottom shelf forms an exit port for dispensing containers;

wherein the plurality of intermediate shelves are configured to form an angled exit channel between the plurality of intermediate shelves and the front wall;

a biased gate pivotally mounted near the front end of each of the plurality of intermediate shelves and to the bottom shelf;

wherein the biased gate on each of the plurality of intermediate shelves pivots under the weight of a front-most container, allowing a front-most container on the plurality of intermediate shelves to enter the exit channel while simultaneously acting as a barrier preventing a subsequent container from entering the exit channel until the front-most container has exited the exit channel, and wherein the biased gates on each of the plurality of intermediate shelves are connected to each other and connected to the biased gate on the bottom shelf such that all of the biased gates operate in unison with each other, allowing a front-most container from each of the plurality of intermediate shelves to enter the exit channel and at the same time into the exit port.

12. The display of claim 11, wherein the plurality of intermediate shelves includes a biased ramp on a top surface of the plurality of intermediate shelves which reduce momentum of a container rolling down the plurality of intermediate shelves and bias under the weight of the container to prevent subsequent containers from putting weight on a front-most container.

13. The display of claim 12, wherein the biased ramp on each of the plurality of intermediate shelves is a plurality of biased ramps on the top surface of the plurality of intermediate shelves.

14. The display of claim 11, wherein each of the plurality of intermediate shelves includes a biased ramp at the rear end of each of the shelves to prevent containers from falling off the rear end of the shelves.

15. A display for storing and dispensing containers, comprising:

a front end and a rear end;

a bottom shelf having a front end and a back end, the bottom shelf having a top surface;

a pair of side walls;

a plurality of intermediate shelves operatively attached to the pair of side walls, each of the plurality of intermediate shelves sloping downwards towards the front end, each of the plurality of intermediate shelves including a biased ramp on a top surface of the plurality of intermediate shelves to reduce momentum of a container rolling down the plurality of intermediate shelves, the biased ramp on the plurality of intermediate shelves configured to bias under the weight of the container to prevent subsequent containers from putting weight on a front-most container on the plurality of intermediate shelves;

a front wall attached to the pair of sidewalls, the front wall positioned so that a gap remains between the front wall and the bottom shelf, allowing a container to pass under the front wall on the bottom shelf;

wherein the bottom shelf forms an exit port for dispensing containers, the exit port extending forward from the front wall;

a biased gate pivotally mounted near the front end of each of the plurality of intermediate shelves and to the top surface of the bottom shelf, the biased ramp configured to reduce momentum of a container rolling down the bottom shelf adjacent to the exit port; and wherein the biased gate on each of the plurality of intermediate shelves pivots under the weight of a front-most container, allowing a front-most container on the plurality of intermediate shelves to enter an exit channel while simultaneously acting as a barrier preventing a subsequent container from entering the exit channel until the front-most container has exited the exit channel, and wherein the biased gates on each of the plurality of intermediate shelves are connected to each other and connected to the biased gate on the bottom shelf such that all of the biased gates operate in unison with each other, allowing a front-most container from each of the plurality of intermediate shelves to enter the exit channel and at the same time into the exit port.

16. The display of claim 15, wherein the at least one intermediate shelf includes a plurality of biased ramps on the top surface of the plurality of intermediate shelves and a plurality of biased ramps on the top surface of the bottom shelf.

17. The display of claim 15, wherein each of the plurality of intermediate shelves and the bottom shelf include a biased ramp at the rear end of each of the intermediate shelves and bottom shelf to prevent containers from falling off the rear end of the plurality of intermediate shelves and the bottom shelf.

18. The display of claim 15, wherein each of the plurality of intermediate shelves is configured to form an angled exit channel.

* * * * *